United States Patent [19]

Awalt, Jr.

[11] Patent Number: 4,556,007

[45] Date of Patent: Dec. 3, 1985

[54] ANCHOR BOOM ASSEMBLY

[75] Inventor: Thomas Y. Awalt, Jr., Pensacola, Fla.

[73] Assignee: Deep Seven Co., Pensacola, Fla.

[21] Appl. No.: 608,430

[22] Filed: May 9, 1984

[51] Int. Cl.[4] ..... B63B 21/22

[52] U.S. Cl. ..... 114/210; 114/364

[58] Field of Search ..... 114/210, 293, 310, 268, 114/364; 294/84

[56] References Cited

U.S. PATENT DOCUMENTS 2,899,924 8/1959 Good ..... 114/210

3,865,065 2/1975 Dennis et al. ..... 114/210

FOREIGN PATENT DOCUMENTS 900284 5/1972 Canada ..... 114/210

274029 9/1927 United Kingdom ..... 114/210

OTHER PUBLICATIONS

UK Patent Application, GB, #2053823, Mangoletsi, 2–81.

*Primary Examiner*—Trygve M. Blix

*Assistant Examiner*—Edwin L. Swinehart

[57] ABSTRACT

An anchor handling boom assembly having an elongated boom and a shank guide member. The shank guide member can be channel-locked along the boom or it can be released to rotate to such a position as to enable the shank of the anchor to easily pass over in retrieval or release. Release of the shank guide member can be made to cause a free fall of the anchor.

8 Claims, 4 Drawing Figures

ANCHOR BOOM ASSEMBLY

BACKGROUND OF THE INVENTION

A. Field of the Invention

This invention relates to anchor booms, davits, and fairleads, and recovery and storage devices for anchors.

B. The Prior Art

Over-the-gunnel anchor devices fall generally into two classes: bow rollers and boom or pulpit type. The boom or pulpit type anchor device ordinarily comprises a roller or fairlead permanently mounted on a pulpit, bow sprit or boom out over the water. Such a mount provides clearance from the side and gunwale as the anchor is retrieved and stowage of sorts on the pulpit, sprit or boom. Such devices are excellent for the retrieval of anchors, but are well known to create a stall problem wherever the operation requires the shank of an anchor hanging vertically to engage and circumvent a roller at angles of about 60°-90°. This can occur when operation is by winch or windless as well as (usually at the lower angle range) by hand operation. In such cases the head of the shank ordinarily comes to rest against the roller and a disproportionate force is required to bring the shank over the roller.

At least three approaches to a solution to the stall problem are noted in examination of the prior art.

U.S. Pat. No. 2,899,924 to Good taught a dipping boom which was ordinarily dipped for the entire operation of dropping, riding, and in this position could easily receive the shank of the anchor from a less unobtainable position. While readily workable, this type of boom was easily broken because boats at anchor often "sail" from side to side creating enormous transverse forces; so that the axis of the boom, when left in the dipped position had to absorb these forces in a situation where the axle mounts were subjected to excessive moments of force created by high leverage. When left in the locked position, the lock was subject to shear from transverse forces as well as excessive upward force on the lock created by the downward pull of the anchor rode.

U.S. Pat. No. 3,865,060 to Dennis, et al. taught a guide arm 12 which could assume a straight or dipped position but which, like the Good device, was designed to ride at, and subject the guide to enormous transverse forces while in, the dipped position.

U.S. Pat. No. 3,635,187 to Webb describes a guide channel which slides within and tilts from a second member which which in turn slides in the boom. Such an arrangement while theoretically workable, is subject to jamming and, again, it does not solve the problem of the transverse force.

Any simple solution to the stall problem which would avoid secondary problems associated with transverse forces would represent a significant advance in the art.

SUMMARY OF THE INVENTION

According to this invention, an elongated anchor boom assembly is provided in which (1) a primary roller (roller of first engagement) is carried on a shank guide (2) the shank guide, carrying both roller and compensating means which is axially mounted on a boom, is shorter than the boom, and mounted thereon so that the roller is relatively close to the axial mount;

(3) the shank guide carries a relatively long operating arm so that it can easily be brought substantially parallel to the boom where it is straddle locked therein or thereon for riding, hauling in long anchor rodes and breaking the anchor loose; and (4) the shank guide can be easily released to guide the shank of the anchor over the roller and break the sharp angle of recovery as well as to facilitate release of the anchor from a stowage position.

In the detailed description, reference will be made to the drawings in which

FIG. 1 is a perspective of a first preferred embodiment showing the shank guide in a position parallel to the boom, FIG. 2 is a perspective of the first preferred showing the shank guide in its lowered position to receive or drop the anchor, FIG. 3 is a perspective of the first preferred embodiment showing an anchor being brought onto the boom, and FIG. 4 is a perspective showing a second preferred embodiment.

DETAILED DESCRIPTION OF THE INVENTION

Figure 1:
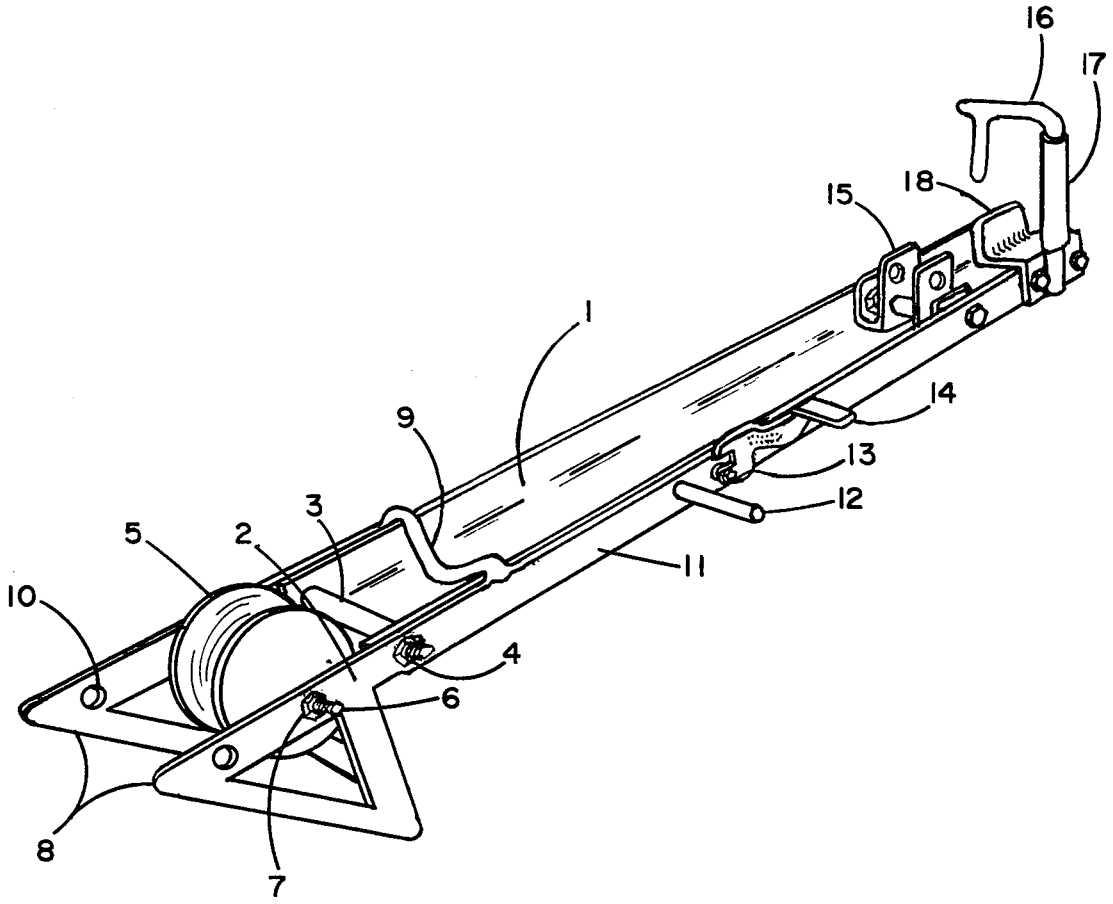

The invention is a boom assembly comprising in combination an elongated boom having a mount portion and a cantilever portion. The boom is preferably but not necessarily channel-shaped to provide greater strength, and a channel and rest for the distal end of the shank of the anchor when it (the anchor shank) is brought into the horizontal position. The mount portion of the boom has mounting means whereby it can be attached to the deck. In its simplest form mounting means comprises bolt holes for bolting to the deck and/or gunwale. Axially mounted on the leading end of the cantilever portion of the boom is a roller, shank guide and fairlead member assembly, hereafter "shank guide member" or "guide member", which comprises a primary roller and fairlead means on one end, an operating arm on the other end and roller dip compensating means between the operating arm and the roller. The compensating means is a portion of or attachment to the member in the form of a slide bar or a second roller which affords rest and a force application point for both rode and shank as either or both are brought from substantially vertical to substantially horizontal. When the rode is passing over the compensating means, it will exert a downward force compensating (through the axial mount) for the downward force being applied to the primary roller. In this retrieval mode the guide member will ordinarily assume a 35°-50° angular position in relation to the boom. When the distal portion of the shank of the anchor (being retrieved) comes against the primary roller, as the shank mounts the roller, an extraordinary downward force is applied to the roller. The roller will dip to receive the shank to an extent permitted by the compensating means, and the compensating means will tend to compensate for the dip and return the member to an intermediate position (between parallel and perpendicular to the boom). As the shank of the anchor moves up, however the force on the rode and the compensating means will cause the guide member to swing to near horizontal. The distance between the primary roller and the compensating means is substantially less than the length of the boom. The effect of this requirement is to provide clearance for the anchor with minimum overall boom length. If the axis for the guide assembly were at or near the gunnel, there would be minimal clearance in the dipped position. If the boom is lengthened and the guide means shortened as in this invention, there is much greater clearance of the flukes when the guide is in the dipped position. Another purpose served by the requirement for the relatively long boom as opposed to a long guide member is the lessening of leverage applied by lateral forces.

The forces applied to such a device in operation are enormous and in most cases the greater the force applied, the more critical is its integrity to the safety of the vessel and passenger. For example, on a device designed for a 35 lb. working Danforth anchor, for vessels 45–54 feet in length, it is not at all unusual for forces in excess of 5,000 lbs to be applied. These forces are not applied in any single direction nor are they applied in a steady manner. In a storm most boats on a single anchor will "sail" in one direction, then another. Pitching will cause jerking and sailing will divert the direction of forces from dead ahead to about 40° on either side. To withstand such forces, in a device of about this size, it is necessary that potentially weak spots be avoided and control be maintained. One such potential weak spot is in a levered shear. Levered shear is reduced as the distance between the primary roller and the axial mount of the guide member is reduced. Levered shear is virtually eliminated when the guide member is straddle locked on the boom. [By "straddle lock" is meant a parallel embracement of the guide member by the boom or the boom by the guide member.] Since straddle locking of the guide member is essential, it must be obtainable under stress and it must hold in this position under stress.

Still another purpose served by the requirement for a short guide assembly is increased control. As the guide assembly is decreased in length, particularly the distance between the axial mount and the primary roller, it becomes easier to control the position of the guide. For example, as explained above, it is desirable to place the guide member in a position parallel to the boom so as to straddle lock the boom during times when maximum forces may be applied. Such a position prevents shear of the axial mount. If the guide member is relatively long, a strong force on the anchor rode would prevent manual movement to the parallel position. To further assist in controlling the position of the guide arm an operating arm is provided with a control force application point thereon which may, in a simple preferred embodiment, be a foot pedal.

The guide member is axially mounted near the leading outboard end of the cantilever portion of the boom in such a manner that the distance between the control force application point and the axial mount ($d_1$) is more than twice the distance between the axial mount and the axis of the primary roller ($d_2$). This characteristic also facilitates control of the guide member.

The distance between the axial mounting means of the guide member and the primary roller plus the distance between the axial mounting means of the guide member and the compensating means ($d_2+d_3$) is preferably less than half the length of the boom ($d_b$) and it is preferred that $d_2$ be substantially (at least 15%) less than the distance ($d_3$) between the axial mounting means and the compensating means ($d_3$) although this feature is not essential to the invention. If $d_2$ is greater than $d_3$ the guide member will work to receive the shank but greater shear forces will be applied to the axial mount when the rode is under stress. A shorter $d_2$ facilitates control and provides strength at the primary roller. A shorter $d_2$ than $d_3$ also permits (with minimal adjustment of $d_2$ and $d_3$ within the described ranges) in standard lightweight type anchors, a balancing of the anchor in such a manner that when unlocked the anchor will remain with the shank at rest along the boom; but when the primary roller is permitted to dip, the short drop of the center of gravity of the anchor along with the upward force of compensating means on the shank of the anchor causes the anchor to roll forward and out over the primary roller and down to the water. This provides a free fall effect for the anchor simply by releasing the guide assembly to the dip position. With CQR (plow) type anchors, however, it is necessary for $d_2$ to be slightly greater than $d_3$ to achieve the same effect. With other types of anchors it is only necessary to select $d_2$ in accordance with the particular center of gravity of the anchor so as to achieve the free fall.

The guide member can be locked in a position substantially parallel to and partially coextensive with the boom and in a straddle lock position for the guide member along the boom for substantially the entire distance ($d_2$) between the mounting means and the compensating means. It is important that the lock itself be situated so as to provide a substantial mechanical advantage over the leverage inherent in $d_2$ so that the distance between the lock and the axial mount $d_4$ is substantially more (at least 25%) than $d_2$. It is preferred that $d_4$ be more than twice $d_2$. This combination of features gives strength to the axial mount for the primary roller, as against both vertical and lateral forces, almost equal to that of the boom itself. Convenient unlocking means is also provided so that the primary roller can be depressed either to drop the anchor more easily or to retrieve the anchor.

Figure 2:
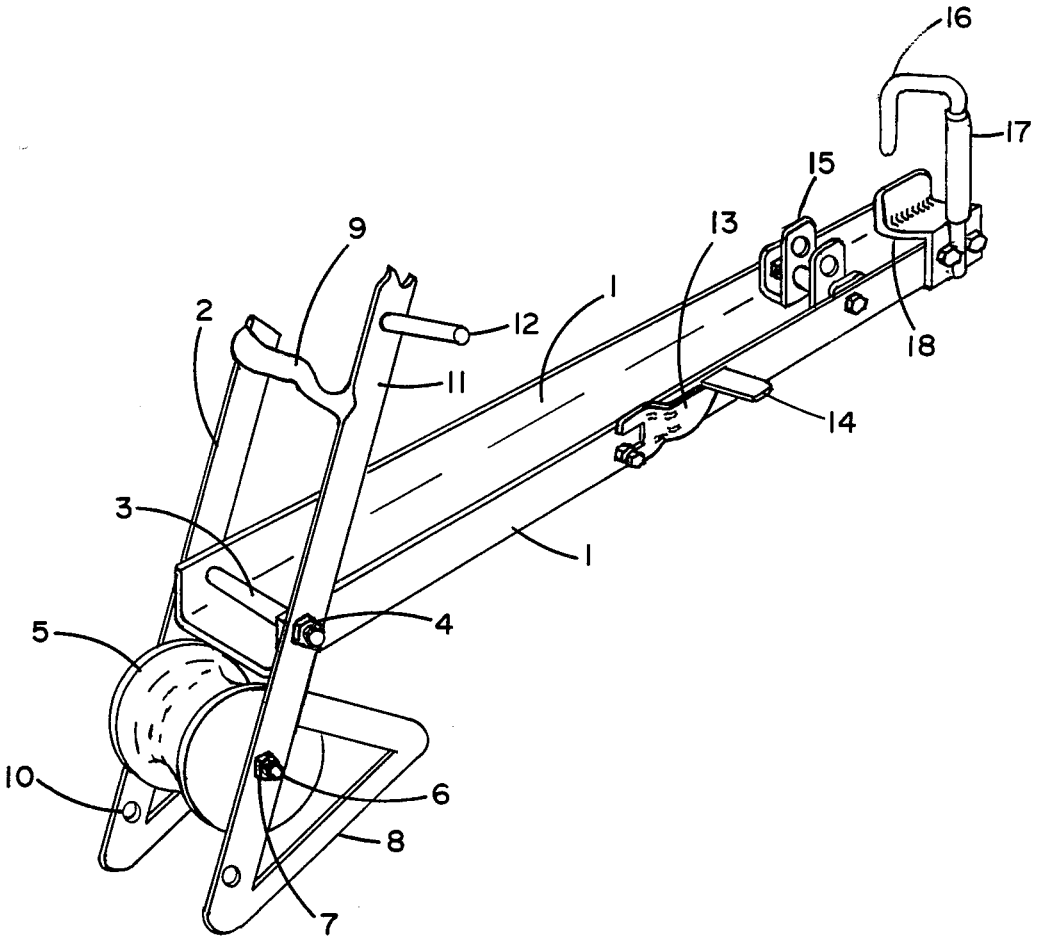
Figure 3:
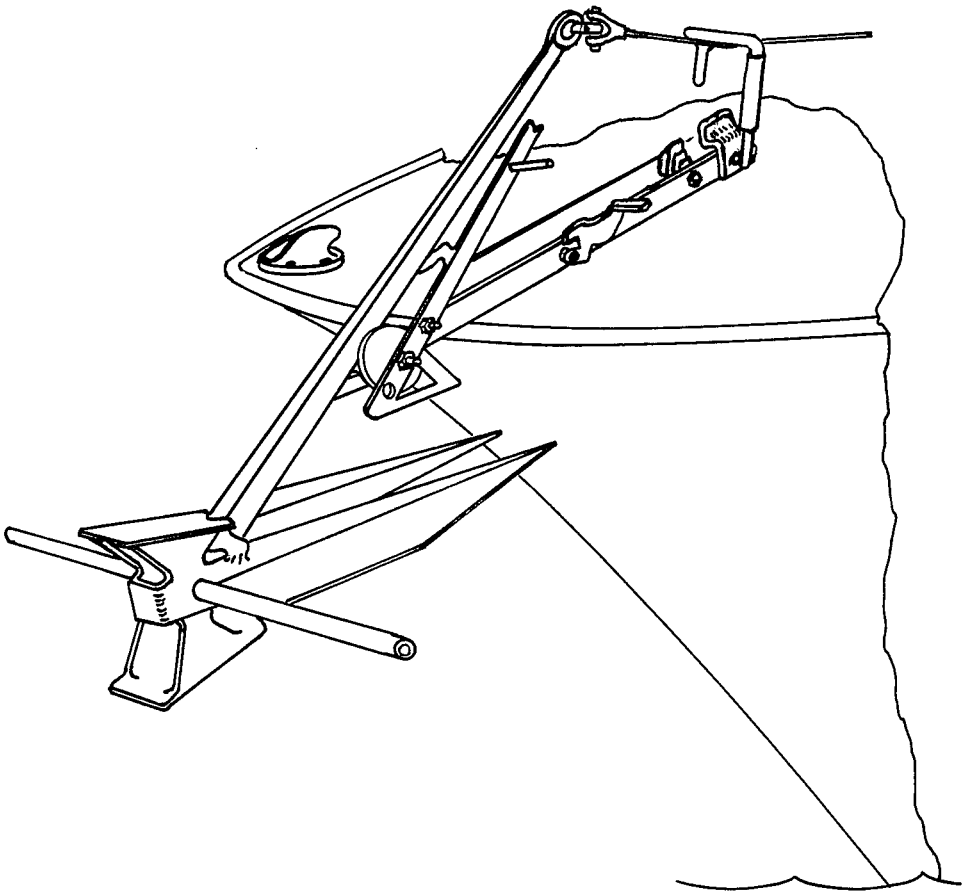

Preferably the locking means is self-actuating in the sense that the guide member snaps into a locked position when the guide member is forced into a straddle lock position with the boom. Preferably the unlocking means is pedal operated on smaller devices for ease of handling. Also on smaller devices the control force application point is preferably a foot pedal for ease of operation. The compensating means may be any surface against which the rode or shank may rest or slide. In smaller devices it may be a rod as shown at FIGS. 1–3. On larger devices it is preferably another roller as depicted at FIG. 4.

Referring now in detail to the drawing:

FIGS. 1 and 2 show the principal operating positions of a first preferred embodiment. In both FIGS. 1 and 2, boom 1 carries on its leading edge guide member 2 axially mounted on bolt 3 with lock nut 4. Guide number 2 carries roller 5 axially mounted on bolt 6 with lock nut 7. Forward of roller 5 are fairlead arms 8 and storm pin eyes 10 for locking a rode in place. To the rear of roller 5 is compensating means 9. Guide member 2 may be manually controlled by operating arm 11 and pedal 12. Lock 13, which is spring loaded and mounted on boom 1, carries pedal release 14. Also mounted on boom 1 is anchor shank lock pin receiver arms 15, rode guide 16 carrying rode guide deflector sleeve 17 and rode track 18.

Figure 4:
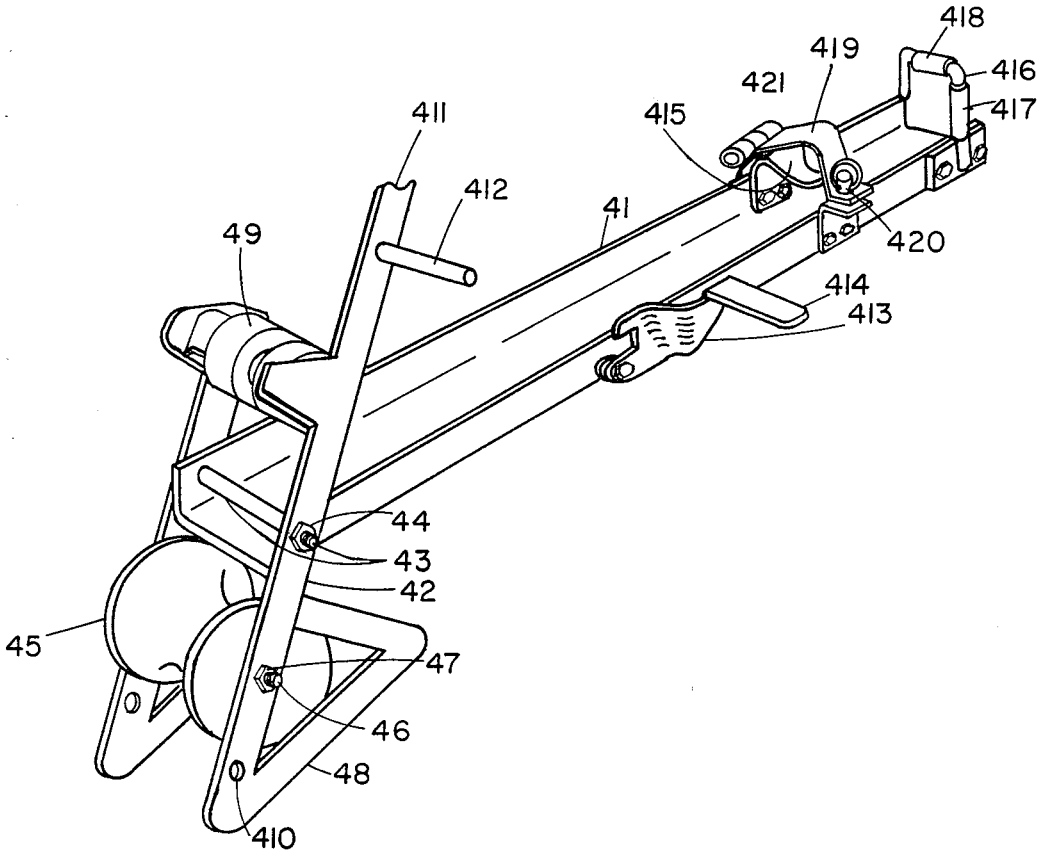

FIG. 4 shows a second preferred embodiment leaving compensating means in the form of a roller and an improved shank lock system. In FIG. 4, boom 41 carries on its leading edge guide number 42 axially mounted on bolt 43 with lock nut 44. Guide number 42 carries principal roller 45 axially mounted on bolt 46 with lock nut 47. Forward of principal roller 45 are fairlead arms 48 and storm pin eyes 410 for locking a rode in place. To the rear of roller 45 is compensating roller 49. Guide number 42 may be manually controlled by operating handle 411 and pedal 412. Lock 413 which is spring loaded and mounted on boom 41, carries pedal release 414. Also mounted on boom 41 is anchor shank receiver arm 415, and anchor shank lock 419. Anchor shank lock 419 is mounted on hinge 421 and carries locking pin 420 which may be used to lock the anchor in place by twisting. To the rear of anchor shank reciever arm 415 is rode guide 416 carrying rode guide sleeves 417 and 418.

In operation the anchor is normally carried with its shank substantially horizontal along the boom, the guide member being in the position shown at FIG. 1. If the anchor is a lightweight fluke type anchor the flukes will point downward ordinarily resting against fairlead arms 8. The shank will rest on roller 5 and it may also bear on compensating means 9. It will be locked at the end of the shank on shank lock pin receiver arms 15. To use the anchor, it is only necessary to press unlocking pedal 14 and feed the rode to the anchor, preferably under rode guide 16. When pedal 14 is depressed, guide member 2 will dip causing the anchor to ride forward and down. When the anchor is on the bottom or on the way to the bottom, pedal 12 should be depressed in order to lock the guide member in its straddle lock horizontal position for setting the anchor and for riding at anchor. It is preferable to leave guide member 2 in the locked position when breaking the anchor free and while bringing the anchor to the surface of the water. Sometime before the shank of the anchor reaches primary roller 5, pedal release 14 should be depressed so as to permit primary roller 5 to dip to receive the shank of the anchor. Recovery of the anchor then proceeds until the anchor is brought to a position with the shank as far back on the boom as roller 5 and fairlead arms 8 permit, at which time it may be locked on receiver arms 15 and guide member 2 again placed in the locked position.

I claim:

1. An anchor handling boom assembly comprising in combination (a) an elongated boom having a mount portion and a cantilever portion;

(b) mounting means for the boom whereby the mount portion can be affixed to the deck of a vessel and the cantilever portion can be cantilevered to overhang the bow or side of the vessel, so as to provide a loading outboard end of the cantilever portion;

(c) a shank guide assembly comprising in combination an elongated frame, a primary roller and fairlead means on one end of the frame, a fixed operating arm extending substantially parallel to the frame away from the other end of the frame to a control force application point near the end of the operating arm opposite the frame and a shank guide dip compensating means between the operating arm and the primary roller, the distance ($d_2+d_3$) between the primary roller and the compensating means being substantially less than the length of the boom (db);

(d) axial mounting means for mounting the guide assembly on the leading outboard end of the cantilever portion, the mounting means located on the guide member, so that the distance ($d_1$) between the control force application point and the axial mounting means is greater than twice the distance ($d_2$) between the primary roller and the axial mounting means;

(e) self-actuating means for locking the guide assembly in a position substantially parallel to and with a portion of the guide assembly substantially coextensive with the boom at a point on the guide member where the distance ($d_4$) between the locking means and the axial mounting means is more than twice the distance ($d_2$) between the axial mounting means and the primary roller and for unlocking and releasing the guide member so as to permit rotation of the shank guide assembly.

2. The boom assembly of claim 1 wherein the the shank guide assembly is so shaped and the distance ($d_2$) between the axial mounting means and the primary roller being such that with the guide/assembly in the locked position an anchor can be balanced on the primary roller with shank at rest along the boom, and when the shank guide assembly is released, a short drop of the primary roller along with a resulting upward force on the shank exerted by the compensating means causes the anchor to roll forward and out over the primary roller.

3. The boom assembly of claim 1 wherein the unlocking means is pedal operated.

4. The boom assembly of claim 1 wherein the control force application point is a foot pedal.

5. The boom assembly of claim 1 wherein the shank guide dip compensating means comprises a bar.

6. The boom assembly of claim 1 wherein the shank guide dip compensating means comprises a roller.

7. The boom assembly of claim 1 wherein the anchor is a plow type anchor, wherein the distance ($d_2$) between the primary roller and the axial mounting means is greater than the distance ($d_3$) between the axial mounting means and the compensating means, wherein the stowed anchor will lay unrestrained with shank along the boom when the guide assembly is in the substantially parallel locked position; and wherein the anchor will tumble over and off the boom when the guide assembly is released from the locked position.

8. The boom assembly of claim 1 wherein the anchor is a lightweight fluke and stock type anchor, wherein the distance ($d_2$) between the primary roller and the axial mounting means is less than the distance ($d_3$) between the compensating means and the axial mounting means; wherein the stowed anchor will lay unrestrained with shank along the boom when the guide assembly is in the substantially parallel locked position; and wherein the anchor will tumbel over and off the boom when the guide assembly is released from the locked position.

* * * * *